United States Patent [19]

Meirow et al.

[11] Patent Number: 4,616,216

[45] Date of Patent: Oct. 7, 1986

[54] EMERGENCY STOP MONITOR

[75] Inventors: Jack Meirow, Sterling Heights, Mich.; Earl J. Schnur, 523 S. Bellevue, Lake Orion, Mich. 48035

[73] Assignee: Earl Joseph Schnur, Lake Orion, Mich.

[21] Appl. No.: 635,042

[22] Filed: Jul. 27, 1984

[51] Int. Cl.[4] ..... G08B 21/00

[52] U.S. Cl. ..... 340/644; 340/500; 340/679

[58] Field of Search ..... 340/639, 679, 652, 644, 340/520, 500

[56] References Cited

U.S. PATENT DOCUMENTS

| | | | |
|---|---|---|---|
| 3,512,405 | 5/1970 | Schlicher | 340/679 X |
| 3,729,734 | 4/1973 | Kipling | 340/679 X |
| 3,872,473 | 3/1975 | Melgaard et al. | 340/644 X |
| 3,960,011 | 6/1976 | Renz et al. | 340/679 X |
| 4,156,432 | 5/1979 | Helwig, Jr. | 340/652 X |
| 4,233,598 | 11/1980 | Green et al. | 340/652 |

OTHER PUBLICATIONS

*IBM Technical Disclosure Bulletin*, "First Alarm Indicator", J. R. Wood, vol. 3, No. 7, Dec. 1960.

*New Electronics* (Great Britain), "First Up Alarm Indicator", J. E. Cooling, vol. 12, No. 10, May 15, 1979.

*Primary Examiner*—James L. Rowland

*Assistant Examiner*—Brian R. Tumm

*Attorney, Agent, or Firm*—Harness, Dickey & Pierce

[57] ABSTRACT

The monitoring device simultaneously senses the voltage at the interconnection points between a plurality of series connected current interrupting devices. When current is interrupted by any one of the devices, the conductivity statuses of all devices are latched and stored until reset in a storage device which provides a signal indicating which of the devices caused current flow to be interrupted. The monitoring device thus detects both intermittent and sustained faults. The monitoring device employs optically isolated digital electronic circuitry for direct interconnection with AC control circuits.

19 Claims, 4 Drawing Figures

EMERGENCY STOP MONITOR

BACKGROUND AND SUMMARY OF THE INVENTION

This invention relates generally to safety equipment for electrically controlled automated equipment. More particularly, the invention relates to equipment for monitoring the status of emergency stop equipment, such as safety gates, manually operated switches, safety interlocks and the like. Although the invention finds particular utility in manufacturing plants and on assembly lines having multiple work stations or where machines work in concert, the invention is equally useful in other monitoring applications.

In an assembly plant or manufacturing plant utilizing automated equipment, it is frequently advantageous to coordinate the operation of a plurality of pieces of automated equipment to work in concert with one another. In this fashion, a workpiece undergoing manufacture proceeds smoothly and efficiently from one work station to the next without inventory buildup or backlog. Each such work station may include a number of different pieces of automated or semi-automated equipment, such as welding stations, shuttles, stamping presses, turn-over devices, bending jigs, and the like. The time during which a workpiece spends at each station will, in general, depend on a number of factors, such as the particular manufacturing process being performed, the size, shape and other physical characteristics of the workpiece, and the moninal speed at which the human operator is working. Frequently considerable thought and effort is devoted to coordinating the times a workpiece spends at each work station in order to prevent unnecessary inventory buildup or backlogs.

Many modern day manufacturing plants which utilize automated equipment employ emergency stop equipment for stopping the automated equipment, or preventing it from starting, in the event of an emergency or to permit maintenance crews to effect repairs. In many applications, particularly those which employ a plurality of pieces of automated equipment working in concert, the emergency stop mechanism for each piece of automated equipment is integrated with other emergency mechanisms to provide an emergency stop system for the entire coordinated assembly line, or at least major portions thereof. In such integrated emergency stop systems a fault or emergency occurring at one work station causes the shut-down of all coordinated work stations until the fault is corrected and the system is reset.

In accordance with present day practices, the integrated emergency stop system usually employs a plurality of series connected, normally closed electrical current interruption devices, each providing a different safety function. The plurality of series connected devices are coupled to receive current from a source of electrical power and to conduct that current to the coil of a relay or other type of current sensing load. When any one of the series connected devices is opened, current flow through the relay coil or other sensor is interrupted, causing power to be interrupted from one or more of the pieces of automated equipment. In conventional practice, the series connected current interrupting devices may be implemented using a variety of different mechanisms, including push button switches for manual operation, safety gates equipped with jumpered terminals which break current flow when opened, electronically controlled or microprocessor controlled switches, and so forth. Such emergency stop systems are provided with test points at the nodes or interconnections between series connected current interruption devices In many applications, several groups of series connected current interruption devices are arranged as parallel branches or legs across the hot and common buses of an alternating current distribution system. Each branch or leg thus comprises a plurality of series connected current interruption devices which deliver logic current to a relay coil in series therewith. Each relay may provide a plurality of contacts or outputs which may be used to make or break current for powering the automated equipment on the assembly line. Frequently one pair of contacts on each branch relay are series connected with one another to make and break control current to a master relay (or groups of master relays) for interrupting power to the entire assembly line when a fault occurs. Such a feature is particularly useful where pieces of automated equipment work in concert with one another and must therefore be shut down whenever a fault occurs in one of the pieces of equipment.

When a fault occurs somewhere in a complex integrated system of the type described above, it is often quite difficult and time consuming to localize and identify which piece of equipment, safety interlock or switch has caused the system to shut down. By examining or metering the plurality of relay contacts a technician can often locate which branch has caused the shut down, although such inspection or metering does not reveal which device in that branch has caused the fault. In order to locate precisely which device has caused fault, the technician has heretofore been forced to visually inspect each of the current interrupting devices or to take voltage measurements at each of the test points along the branch until the open circuit is isolated and identified. In a complex control system, as found in many manufacturing plants and along many assembly lines, such procedures can cause costly down time. Even more difficult to identify is the intermittent fault, which may last long enough to trip the emergency stop relays, but which repairs or corrects itself before the technician can localize and identify it. Often times faulty components can produce a frustrating string of such intermittent faults before the device fails completely. There has heretofore been no economically way of quickly locating either the sustained fault or the intermittent fault.

The present invention solves the problem of identifying both the sustained fault and the intermittent fault quickly and easily. The invention is well suited for use in manufacturing plants and on assembly lines or wherever control circuits are used to control automated or semi-automated equipment. In accordance with the invention an apparatus for monitoring the activity states of a plurality of current altering devices in a circuit capable of conducting current from a source to a load is provided. The apparatus comprises a monitoring means electrically coupled to the current altering devices for providing a plurality of fault status signals. These fault status signals indicate the activity states of each of the current altering devices. Preferably, such monitoring occurs continuously. The invention further includes a means for providing a strobe signal when the current flow is altered or interrupted by one or more of the current altering devices. A means for storing the fault status signals in response to the strobe signal is provided which produces logic signals indicative of the stored fault status signals. A fault identifying means is responsive to the logic signals for identifying at least one of the devices which altered or interrupted the current flow and for providing an indication thereof. When one or more of the current flow altering devices causes a fault, alteration or break in the current flow, the activity statuses of all current altering devices are strobed into and latched in the storing means where the status signals remain latched until the system is manually reset. In this fashion, even intermittent faults can be readily localized and identified. The fault identifying means compares the stored fault status signals and identifies the current altering device closest to the source of control power supply which has caused the break in control current. The invention is configured to permit a plurality of such activity or conductivity state monitoring apparatuses to be cascaded together, in daisy-chain fashion. While the invention is well adapted for monitoring series connected current interrupting devices, the invention is equally useable for monitoring independently operating devices.

For a more complete understanding of the invention, its objects and advantages, reference may be had to the following specification and to the accompanying drawings.

DESCRIPTION OF THE PREFERRED EMBODIMENT

Figure 1:
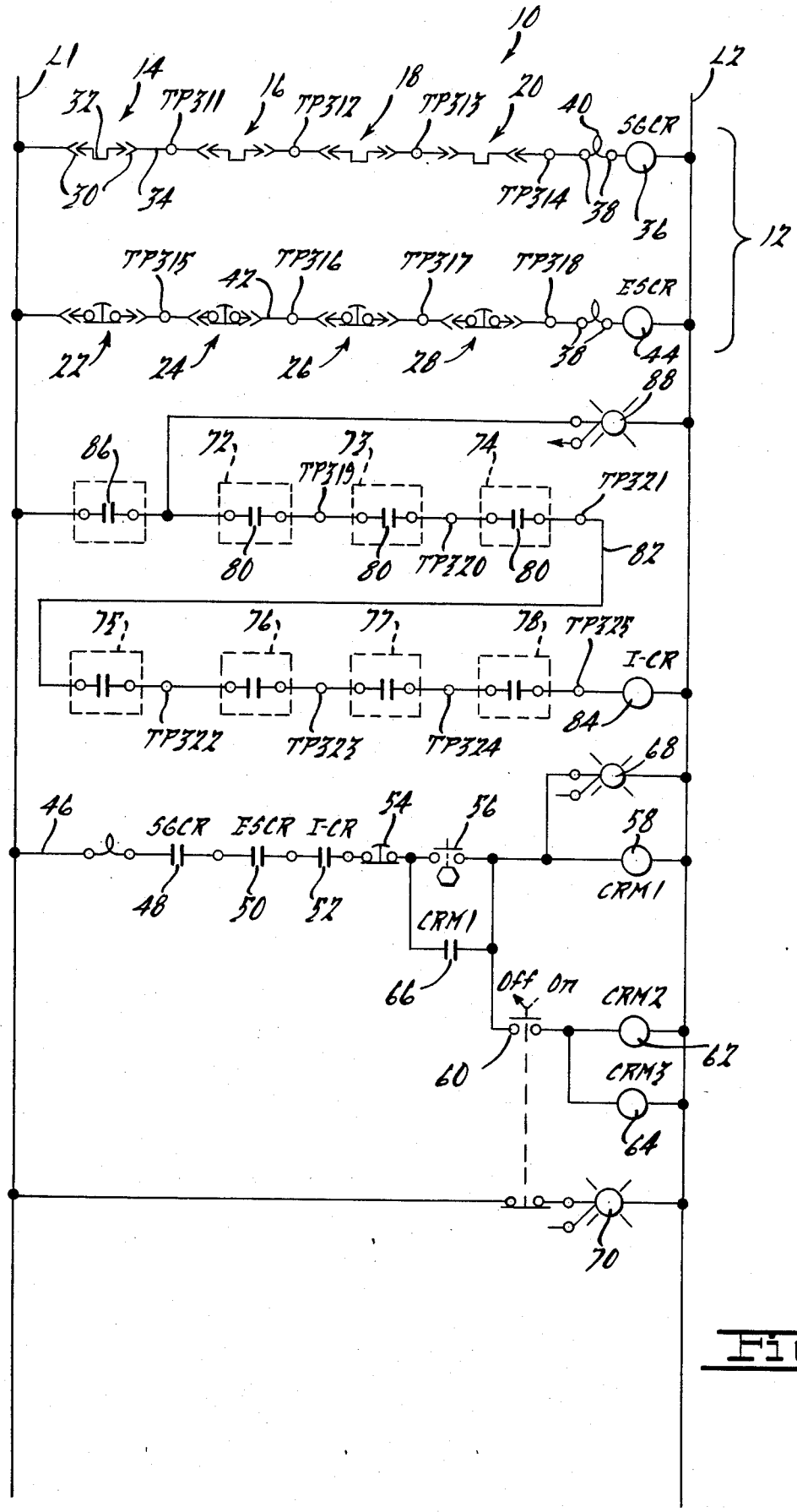
FIG. 1 is a schematic ladder diagram illustrating an exemplary control logic circuit for a multiple station automated equipment system with which the invention may be utilized.

With reference to FIG. 1 an exemplary control logic circuit for a multiple station automated equipment system is illustrated. The circuit shown in FIG. 1 represents a typical control system with which the emergency stop monitor apparatus of the invention may be utilized. It will, of course, be understood that the control circuit illustrated in FIG. 1 is used merely to teach the principles of the invention and is not intended as a limitation upon the scope of the invention as set forth in the appended claims. FIG. 1 depicts a ladder control circuit 10 consisting of a plurality of control stages. More specifically, FIG. 1 illustrates a first stage 12 comprising a plurality of series connected safety gates 14, 16, 18 and 20 and further comprising a plurality of manually operable emergency stop pushbutton switches 22, 24, 26 and 28. The safety gates 14–20 each comprise a pair of terminals 30 and a current conducting jumper 32 coupled between terminals 30 for breaking current flow when the safety gate is opened. Such safety gates may be used, for example, to establish a safety boundary or cage to prevent automated equipment disposed within the safety boundary or cage from being operated when the safety gate is opened to permit human access to the equipment. The emergency stop pushbutton switches 22–28 may be located at each work station to permit the human operators to interrupt the automated equipment in the event of an emergency. The safety gates 14–20 define a first series branch or leg 34 connected in series with the coil 36 of a safety gate control relay (SGCR). If desired, series leg 34 may also include one or more pairs of auxiliary terminals 38 to provide expansion room for future safety gates. In order to maintain current flow through series leg 34 these auxiliary terminals 38 are tied together with jumpers 40. Similarly, pushbutton switches 22–28 define a second series branch or leg 42, which may also include jumpered auxiliary terminals 38. The second series leg 42 is connected in series with the coil 44 of an emergency stop control relay (ESCR). Series legs 34 and 42, including the respective relay coils 36 and 44, are connected in parallel across the alternating current distribution system buses L1 and L2 in ladder fashion. For purposes of understanding the invention bus L1 may be considered as the hot side of the alternating current distribution system, with bus L2 being considered as the common side thereof. This convention is adopted for purposes of illustration only as the invention may also be implemented in control system coupled to the alternating current distribution system with the opposite sense of polarity. Assuming the L1 bus to be the hot side of the distribution system, current flow is from left to right through series legs 34 and 42. Thus, current interrupting devices (the safety gates and the emergency stop pushbutton switches) closer to bus L1 are also considered to be closer to the power source. In other words, safety gate 14 is closer to the power source than safety gate 18, for example; likewise pushbutton switch 22 is closer to the power source than pushbutton switch 24.

Also coupled across current distribution buses L1 and L2 is a master series leg 46. Master leg 46 comprises a plurality of current interrupting contacts which make or break current flow under relay control from other parts of the control circuit. Master leg 46 includes a pair of contacts 48 of the safety gate control relay (SGCR) which remain closed and thus conduct current so long as current is flowing through relay coil 36. The operation of master leg 46 thus depends upon logic current flow in the other legs, as may be seen by the following example. If, for example, one of the safety gates 14–20 is opened, series current no longer flows through first leg 34; coil 36 of the safety gate control relay is no longer energized; and therefore contacts 48 of the safety gate control relay open to interrupt current flow through master leg 46.

Master leg 46 also includes a pair of contacts 50 of the emergency stop control relay (ESCR). The emergency stop control relay, it will be recalled, is responsive to the emergency stop pushbutton switches 22–28. Master leg 46 further includes a third pair of contacts 52 of an interlock control relay (I-CR). In a multi-station system untilizing multiple pieces of automated equipment, for example, the interlock control relay is responsive to emergency stop conditions in parts of the control circuit or stages other than first stage 12. This interlock control system for multi-stage circuits will be discussed more fully below.

Leg 46 further includes master stop pushbutton switch 54 in conjunction with a master start momentary pushbutton switch 56. Master leg 46 provides current for one or more master control relays. In FIG. 1, master leg 46 provides current directly to coil 58 of a first master relay (CRM1), and delivers current through switch 60 to coil 62 of a second master control relay (CRM2) and to coil 64 of a third master control relay (CRM3). Switch 60 is provided so that control current to coils 62 and 64 can be interrupted without breaking current flow to coil 58. The first master control relay (CRM1) may be used to provide a pair of contacts 66 for sealing or latching the master leg current flow in the "on" state once master start pushbutton switch 56 has been momentarily depressed. The second and third master relays are fed in parallel and provide multiple outputs for controlling multiple automated devices. For example, each of the second and third master relays may provide eight outputs, thus the parallel arrangement depicted in FIG. 1 would provide 16 outputs. By setting switch 60 to the open circuit or "off" position, shown in FIG. 1, control current to the second and third master relays is interrupted, yet the first master relay remains energized. With such a switch setting any motors, valves, automated equipment, or the like, can be shut down while leaving the logic of control circuit 10 on for circuit tests. "Power on" indicator light 68 is connected in parallel across coil 58 for providing a visual indication when the first master relay is energized. A second visual indicator 70 is coupled to switch 60 for indicating switch 60 is in the "off" position.

As noted above, the interlock control relay I-CR is responsive to a plurality of control circuit stages comprising current interrupting devices other than those of first stage 12. FIG. 1 illustrates a typical eight stage control configuration. First stage 12 is shown in detail, while second stage 72, third stage 73, fourth stage 74, fifth stage 75, sixth stage 76, seventh stage 77 and eighth stage 78 are shown in abbreviated fashion. It will be understood that stages 72–78 may be contructed in a fashion similar to first stage 12, thus just as leg 42 of first stage 12 included in emergency stop control relay coil 44, each of the remaining stages 72–78 may also include an emergency stop control relay and coil. Each of these emergency stop control relays includes a pair of contacts 80 which are series connected with one another to define interlock control leg 82. Interlock control leg 82 also includes coil 84 of the interlock control relay (I-CR). This interlock control relay, it will be recalled, operates the pair of contacts 52 in the master series leg 46. If a microprocessor is being utilized in the control circuit 10, a pair of contacts 86 may be included in interlock control leg 82 for conducting current in the interlock control leg when microprocessor power is on. If desired, a visual indicator 88 may be coupled between bus L2 and the downstream side of contacts 86 to provide a visual indicator when microprocessor power is turned on. By tracing the current flow through interlock control leg 82 it will be seen that if the microprocessor power is turned off, or if the emergency stop control relay for any of the stages 72–78 has been de-energized, the interlock control relay coil 84 will be de-energized, thereby causing contacts 52 to open and break current through master leg 46. In this fashion, a plurality of machines or work stations can be coordinated or interlocked so that a fault or emergency at any one of the stations will shut down power to the entire collection of automated equipment.

In each branch or leg the series connected current interrupting devices are interconnected with one another at nodes providing test points which may be tested or interrogated by the controls engineer or technician to determine where an open circuit condition has occurred, provided the open circuit condition is not intermittent or has not self-corrected before test measurements. The present invention is adapted for coupling directly to these test points and is thereby capable of monitoring the current conductivity states of each of the current interrupting devices substantially simultaneously. It will, of course, be understood that while the control circuit shown in FIG. 1 utilizes current interrupting devices of the mechanical switching variety (i.e., jumpered terminals, pushbutton switches, relay contacts and the like) the monitor circuit of the present invention may also be utilized with solid state switching devices or with other switching device equivalents. For convenience, the test points have been assigned reference numerals beginning with a TP prefix where applicable in FIGS. 1 through 3.

Figure 2:
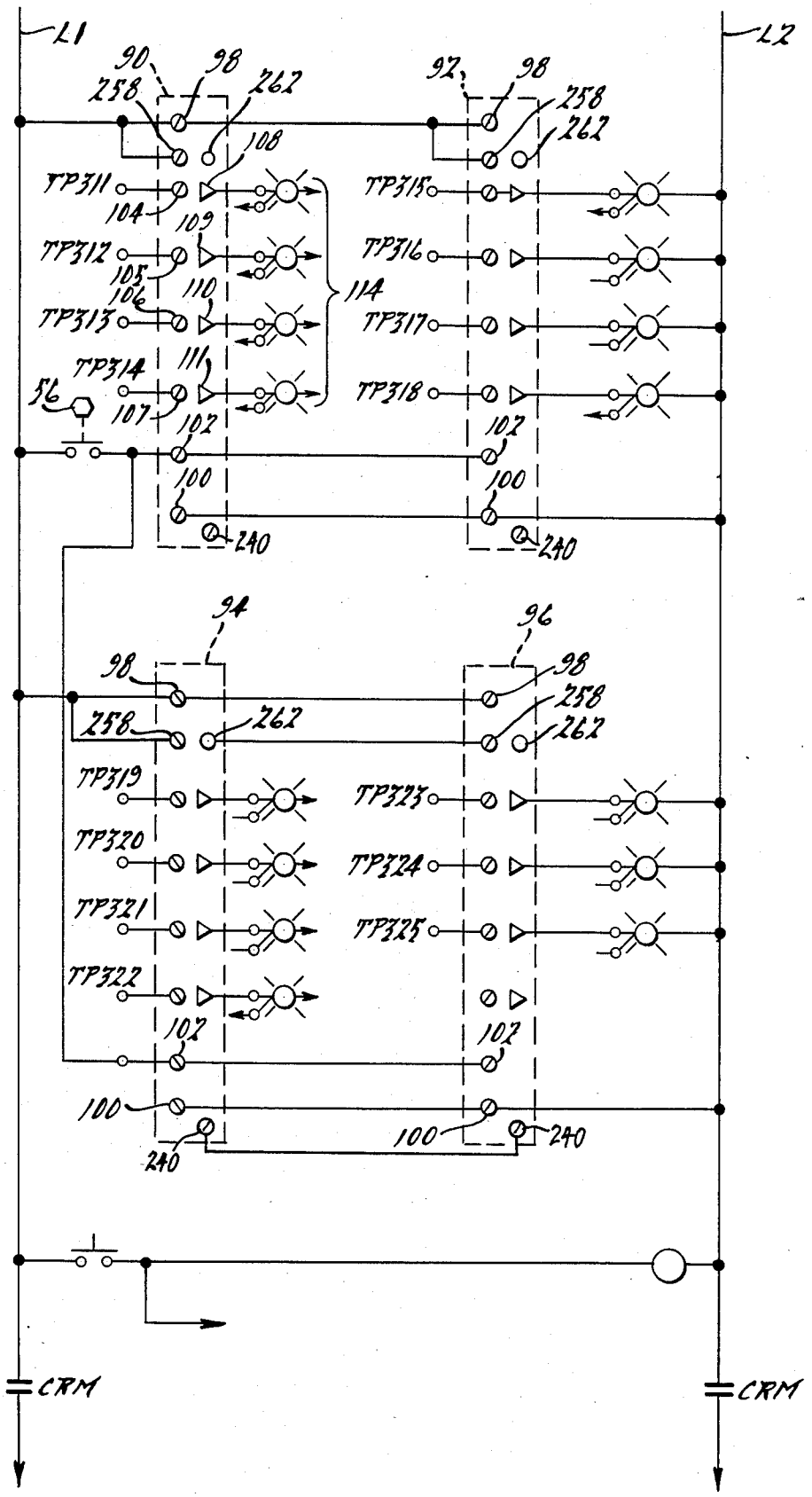
FIG. 2 is a schematic ladder diagram illustrating the interconnection of the invention with the logic circuit of FIG. 1.

Referring now to FIG. 2, the emergency stop monitor of the invention is illustrated in block diagram form as a plurality of emergency stop control modules 90, 92, 94 and 96. Modules 90–96 are each constructed in essentially the same fashion, therefore only module 90 will be discussed in detail. Module 90 (as well as the other modules) includes a pair of power terminals 98 and 100. Power terminal 98 is coupled to bus L1, while power terminal 100 is coupled to bus L2. The module further includes a reset terminal 102 which may be coupled to the master start pushbutton switch 56, or another equivalent switch, to receive system reset signals, as will be more fully discussed below. The module also includes a plurality of input terminals 104, 105, 106 and 107 for connection to selected test points within the control circuit 10 of FIG. 1. A plurality of output terminals 108 109, 110 and 111 are also provided for connection to signal lights 114. As will be explained below, the module produces output signals which illuminate a selected one of these signal lights, corresponding to a particular current interrupting device, when a fault is detected at one of the test points to which the monitor is connected. In addition, each module is provided with a cascade input terminal 258 and a cascade output terminal 262. Although the presently preferred embodiment uses individual modules each having four inputs and four outputs, the invention is also capable of being implemented using a different number of input and output terminals. Furthermore, while four individual modules have been illustrated in FIG. 2, this is not intended as a limitation upon the scope of the invention, since greater or fewer number of modules may be used depending upon the control system requirements.

With reference to FIGS. 1 and 2 it will be noted that each of the input terminals of modules 90 through 96 has also been labeled with a test point designation (numerals beginning with a TP prefix) corresponding to the test point assignments in FIG. 1. This designation is intended to indicate that the input terminal with a given test point designation is electrically coupled to the test point in FIG. 1 bearing the same test point designation. For example, input terminal 104 of module 90 is coupled to test point TP311; input terminal 105 of module 90 is coupled to test point TP312; and so forth. In some instances a given series leg may have more than four series connected current interrupting devices. Interlock control leg 82, for example, has eight current interrupting stages 72–78. In order to accommodate all eight stages, modules 94 and 96 are cascaded together by coupling the cascade output 262 of module 94 to the cascade input of module 96. By so doing, modules 94 and 96 work together to effectively provide an eight terminal module. As seen in FIG. 2, modules 90 and 92 are not cascaded together. Since both first and second series legs 34 and 42 comprise only four current interrupting deives, cascading is not necessary.

Figure 3:
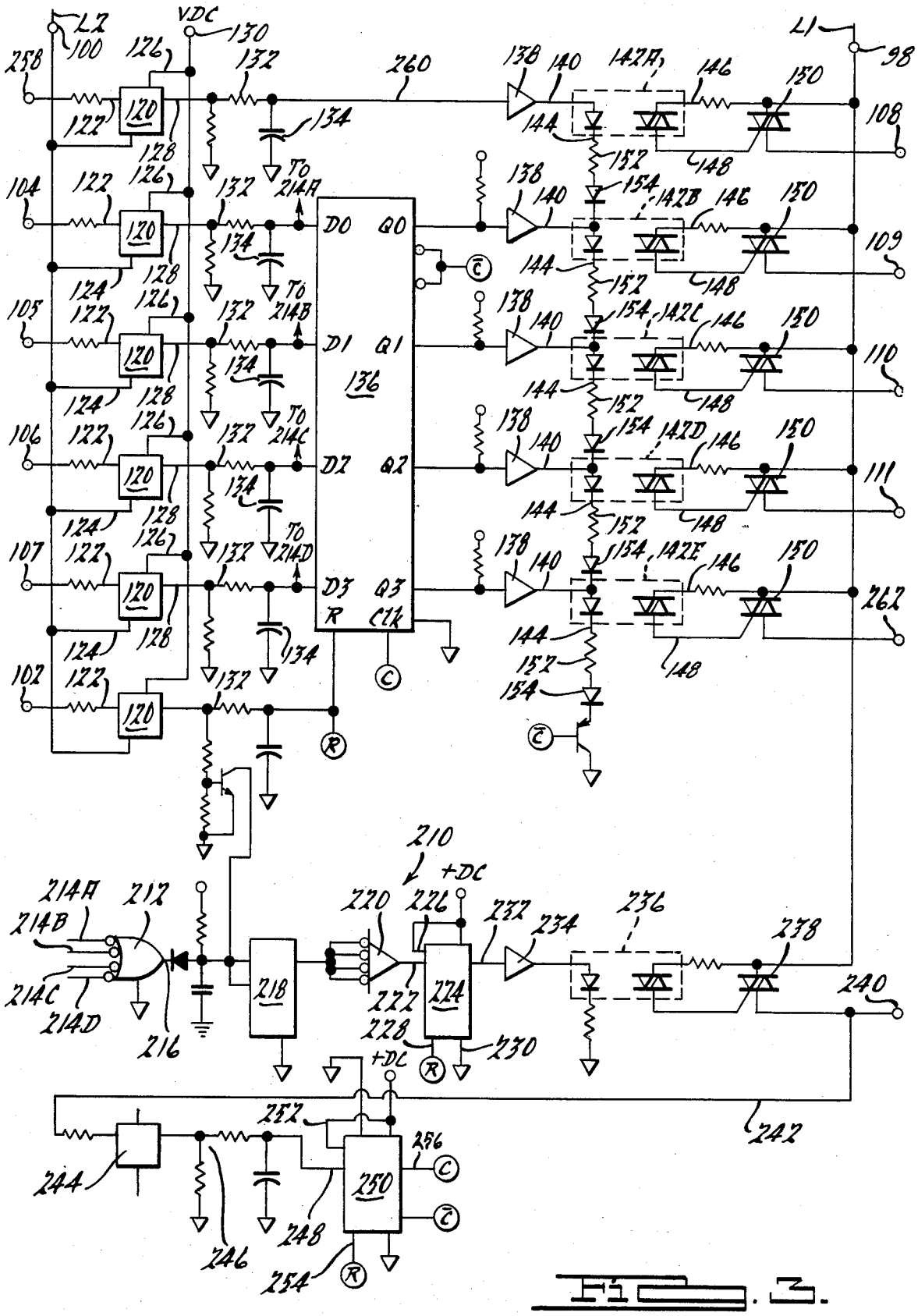
FIG. 3 is a schematic diagram illustrating the presently preferred embodiment of the invention.

Having thus described the emergency stop monitor of the invention in its modular form and the interconnection thereof to an exemplary control circuit, a detailed description of a single module (such as module 90) now follows. With reference to FIG. 3 module 90 (or likewise modules 92, 94 and 96) is shown in detail. Note that power terminal 98 for coupling to bus L1 has been illustrated on the right hand side of the schematic diagram, while power terminal 100 for coupling to bus L2 has been shown on the left hand side of the schematic diagram. This has been done to depict the electronic circuit of the invention in such a way that signal flow from input terminals 104 through 107 proceeds from left to right toward output terminals 108 through 111. Each of the input terminals 104 through 107 is coupled to an opto-isolator 120 via a first input terminal 122. Likewise cascade input 258 is also coupled to an opto-isolator 120. A second input terminal 124 of each opto-isolator 120 is coupled to bus L2 through power terminal 100. These input terminals 122 and 124 are internally connected to a pair of back to back light emitting diodes which, when energized, transmit an optical signal to an internal photodiode, which is in turn coupled to output terminals 126 and 128 or opto-isolator 120. Output terminal 126 is coupled to a source of DC bias voltage 130 while output terminal 128 provides DC voltage signals which are switched on and off in accordance with signals applied at the input terminals 104 through 107 and cascade input 258. Each output terminal 128 associated with inputs 104 through 107 is coupled through a voltage divider network 132 with filter capacitor 134 to an input terminal (D0, D1, D2 and D3) of a quad latch circuit 136. The output terminal 128 associated with cascade input 258 is not coupled to the quad latch, but is connected directly to an output driver amplifier 138. Quad latch circuit 136 may be implemented using a 4076 integrated circuit which provides a three state quad D flip flop circuit on a monolithic CMOS chip. The opto-isolators 120 may be implemented using H11AA2 opto-isolator packages.

Quad latch 136 provides four output terminals (Q0, Q1, Q2 and Q3) as well as a reset terminal R and clock terminal CLK. The reset signal for application to terminal R of quad latch 136 is derived from reset signals on reset terminal 102 and may be supplied by actuating switch 56. Termianl 102 is also coupled through an opto-isolator 120 and voltage divider network 132; the divider network 132 is coupled to reset terminal R of quad latch 136. The same reset signal is also coupled to other points in the circuit as will be discussed further below. Clock terminal CLK of quad latch 136 receives clock signals or strobe signals, generated elsewhere in the circuit. The strobe signals cause signals at input terminals D0, D1, D2 and D3 indicative of the conductivity statuses of the current interrupting devices being monitored, to be latched and stored in the internal flip flops of the quad latch where they may be read at output terminals Q0, Q1, Q2 and Q3. Each of these output terminals is coupled to an output driver amplifier 138. The driver amplifiers, including the one associated with cascade input 258, are connected to the input terminal 140 of one of a plurality of a second opto-isolators 142 (also individually designated 142A, 142B, 142C, 142D and 142E). Opto-isolators 142 each provide a second input terminal 144 and a pair of output terminals 146 and 148. The output terminals 146 and 148 are coupled to triacs 150, which are in turn connected between bus L1 and output terminals 108, 109, 110 and 111 and cascade output 262. Opto-isolators 142 may be implemented using H11J5 opto-isolator packages.

As illustrated in FIG. 3, opto-isolators 142 are connected in ladder fashion, wherein input terminal 144 of a first one of the opto-isolators (142A) is coupled through a resistor 152 and diode 154, to the first input terminal 140 of a second one of the opto-isolators (142B); and wherein terminal 144 of a second one of the opto-isolators (142B) is coupled to terminal 140 of a third one of the opto-isolators (142C) and so forth. The opto-isolators 142 are interconnected using load resistors 152 to establish a voltage drop and diodes 154 for preventing current backflow.

The circuit for generating clock signals is illustrated generally as clock generator circuit 210. Circuit 210 comprises logic gate 212 which has a plurality of input terminals 214A, 214B, 214C and 214D coupled to quad latch input terminals D0, D1, D2 and D3, respectively. The actual connections between the input terminals of logic gate 212 and quad latch 136 have been delected from FIG. 3 to simplify illustration, however it will be understood that in practicing the invention, the respective input terminals of logic gate 212 and quad latch 136 are coupled together as indicated above. Logic gate 212 provides an inverting boolean OR function (NOR) whereby if any one or more of the input terminals 214A–214D drop to a logical low level, an output signal indicative that a fault has occurred is produced at output terminal 216 and applied to delay timer 218. Logic gate 212 may be implemented using a 4012 integrated circuit or comparable combinational logic gate as will be understood by those skilled in the art. Delay timer 218 may be implemented using a NE555 integrated circuit.

Figure 4:
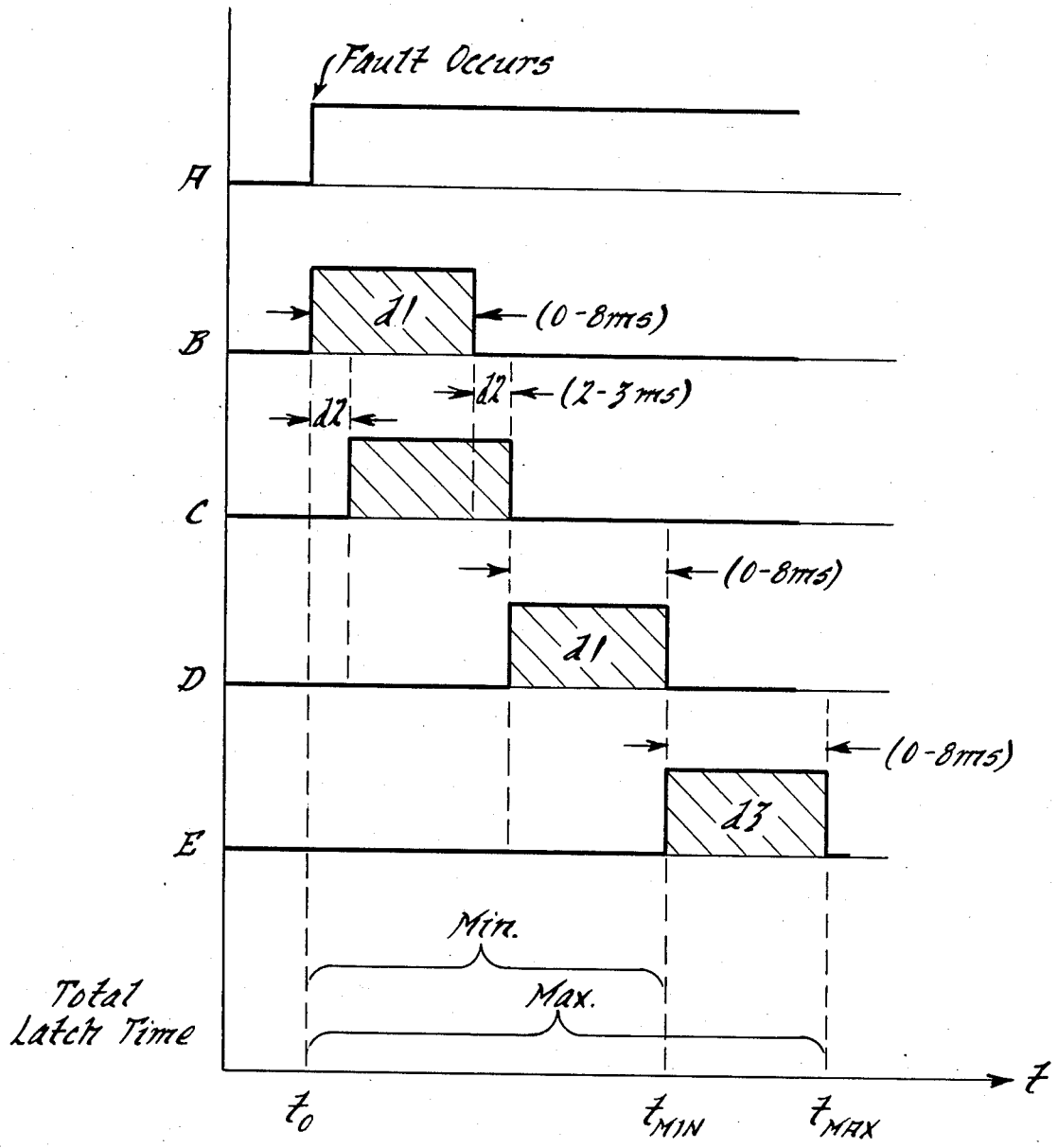
FIG. 4 is a timing diagram illustrating the invention in operation.

When triggered by signals from output terminal 216, delay timer 218 provides a clocking pulse only after a predetermined time has elapsed, see FIG. 4. In practice, the delay timer is used to prevent false triggering in response to line voltage fluctuations or noise. A delay of two to three milliseconds is presently preferred.

FIG. 4 illustrates the timing of the present invention. Line A illustrates the condition where a fault occurs at time $t_0$. The occurrence of such a fault results in one of the opto-isolators 120 being energized. Since the opto-isolators 120 are responsive to alternating current, the occurrence of a DC output will depend upon when in the AC cycle the fault occurs. If, for example, the fault occurs when the AC wave form is at a zero crossing, the DC output may be delayed up to approximately eight milliseconds. If, on the other hand, the fault occurs when the AC wave form is at or near peak voltage, the DC output will occur substantially simultaneously. Line B of FIG. 4 illustrates the 0–8 millisecond ambiguity in opto-isolator response time as a shaded block labeled d1. Line C of FIG. 4 illustrates the delay attributable to the delay timer 218. This delay, denoted as d2, is approximately two to three milliseconds in the preferred embodiment. Line D illustrates a second ambiguity d1 of 0–8 milliseconds, attributable to the opto-isolator 244. Line E illustrates an additional delay d3 of 0–8 milliseconds, attributable to opto-isolator 236. When all of these delays are totalled, as illustrated in FIG. 4, a total latch time range results. The latch time ranges from a minimum time of $t_{min}-t_0$, to a maximum time of $t_{max}-t_0$.

Referring again to FIG. 3, the output of delay timer 218 is conditioned through inverter 220 for application to the clock terminal 222 of first flip flop 224. Inverter 220 may be implemented using a 4012 integrated circuit and first flip flop 224 may be implemented using a 4013 integrated circuit with its D terminal 226 tied to a source of logical high voltage such as the positive DC supply. The reset terminal 228 is coupled to a reset node for receiving reset signals in accordance with signals applied to reset terminal 102 of the module. For illustration purposes, this reset node is designated generally by reference character R, and may be found at several locations throughout the circuit diagram of FIG. 3. Such designation is intended to convey that all such points with the R designation are connected together. A similar illustration technique is used with respect to the clock node which is designated generally by reference character C throughout the schematic diagram of FIG. 3. All such nodes with the C designation are coupled together. Likewise, a similar designation $\overline{C}$ is used to denote the NOT CLOCK terminal of flip flop 250. The NOT CLOCK signal is used to enable quad latch 136 when a fault occurs. Otherwise latch 136 remains in the floating state or tristate. The set or S terminal 230 of flip flop 224 is grounded, while the output terminal 232 is coupled via output driver amplifier 234 to opto-isolator 236. Opto-isolator 236 in turn drives triac 238 which is coupled between bus L1 and clock cascading terminal 240. When a plurality of emergency stop control modules are cascaded or daisy-chained together their respective clock cascading terminals 240 are interconnected so that a fault detected by any one of the modules will result in a clock or strobe signal being applied to all of the modules substantially simultaneously. Opto-isolator 236 may be implemented using a H11J5 opto-isolator package. The output of triac 238 is coupled via lead 242 to opto-isolator 244. Opto-isolator 244 may be implemented using a H11AA2 opto-isolator package. Opto-isolator 244 is coupled through filtered resistive divider network 246 to the clock terminal 248 of flip flop 250. Flip flop 250 may be implemented using a 4013 integrated circuit with its D terminal 252 coupled to a logical high point such as to the positive DC supply. The reset terminal 254 of the flip flop 250 is coupled to reset node R while the output terminal 256 thereof is coupled to clock node C for providing a strobe signal to the quad latch 136.

In operation, the circuit of the invention continuously and simultaneously monitors each of the test points between series connected current interrupting devices to determine when and if current flow is interrupted and to provide an indication of which device caused the interruption. As an example of its operation, let it be assumed that safety gate 16 is momentarily opened, causing a momentary interruption in the logic current flowing in leg 34. When current is interrupted by this device test point TP 311 remains at the line potential of bus L1 (assumed by convention to be the power source), while the remaining test points TP 312, TP 313 and TP 314 are isolated from bus L1 and are at the potential of bus L2 (assumed by convention to be at common or ground potential). Emergency stop control monitor 90 is coupled to these test points and therefore input terminals 104, 105, 106 and 107 are at the same potential as the test points. When not using several cascaded modules to monitor a given series leg, the cascade input 258 are wired "high". For this example it is assumed cascade input 258 is wired "high".

To continue with the example, referring to FIG. 3, input terminal 104 will remain at the supply potential of bus L1, while inputs 105, 106 and 107 will drop to the potential of bus L2. It is assumed that cascade input 258 remains high (i.e., supply potential). As the opto-isolators 120 associated with input terminals 105, 106 and 107 are no longer energized, input terminals D1, D2 and D3 of quad latch 136 drop to a logical low state at ground potential. Since the opto-isolator 120 associated with input terminal 104 is still energized by being coupled across buses L1 and L2, the input terminal D0 of quad latch 136 remains at a logical high potential.

Meanwhile logic gate 212 senses that one or more of its input terminals have dropped to a logical low state (precisely, terminals 214B, 214C, and 214D). Logic gate 212 triggers delay timer 218 to begin its predetermined counting cycle. Assuming that safety gate 16 remained open for a sufficiently long period of time (greater than two to three milliseconds) delay timer 218, acting through inverter 220, clocks flip flop 224 to change from a first bistable state to a second bistable state. In the second bistable state, opto-isolator 236 is caused to conduct, thereby energizing triac 238. Triac 238 in turn switches "on", connecting clock cascading terminal 240 with bus L1 and also energizing opto-isolator 244. Opto-isolator 244 produces a DC output signal which clocks flip flop 250, thereby causing it to change from its first bistable state to its second bistable state. The output of flip flop 250 in turn enables and clocks or strobes quad latch 136, whereupon the logical states at the input terminals D0-D3 are latched and stored in quad latch 136 until that device is manually reset. Quad latch 136 thus provides a logical high output state at output Q0 and logical low states at outputs Q1, Q2 and Q3. Such outputs will remain latched or frozen even if safety gate 16 is thereafter closed to permit current flow through leg 34.

As cascade input 258 remains high, lead 260 is at a logical high DC potential, (the same as output Q0 of quad latch 136). All of the other quad latch outputs Q1, Q2 and Q3 are logically low. Therefore, in this example, since lead 260 and output Q0 are at the same potential, no current flows through opto-isolator 142A and output terminal 108 remains deenergized or switched "off". Since output terminals Q0 and Q1 are at different logical potentials, current will flow through opto-isolator 142B, causing output terminal 109 to be switched "on". Since the remaining terminals Q1, Q2 and Q3 are all at the same low potential, the opto-isolators assocated therewith are not energized and the remaining output terminals remain switched "off". Output 109 being the only one energized, only the signal light 114 connected to it will be illuminated, giving a clear indication of precisely which current interrupting device caused the fault—namely safety gate 16.

Once the fault has been identified and corrected, the system may be reset by momentarily depressing push-button switch 56 to apply an AC voltage at reset terminal 102. Opto-isolator 120 coupled to terminal 102 in response to the applied AC voltage produces a logical high signal which resets quad latch 136, as well as flip flops 224 and 250. Assuming that there are no other faults at this time, quad latch 136 resumes its floating state or tristate. If, on the other hand, a fault remains at one of the other current interrupting devices in the system, the above described cycle will repeat to identify the precise location of the remaining fault. In general, the monitor of the present invention, when confronted with a plurality of simultaneously occurring faults, will first locate the fault occurring closest to the power source. Once the fault closest to the power source is corrected and the reset signal given, the monitor will then identify the next fault closest to the power source. In other words, if faults simultaneously occur in stages 72, 73 and 74 of interlock control leg 82, the monitor will first illuminate the signal light 114 associated with stage 72. When the fault at stage 72 is corrected and reset signal given, the monitor will then illuminate the signal light associated with stage 73. When the fault at stage 73 is corrected and the reset signal given the monitor will then illuminate the signal light associated with stage 74.

While the invention has been described in its preferred embodiment, it is to be understood that the invention is capable of modification without departing from the true scope and spirit of the invention in its broader aspect.

We claim:

1. An apparatus for monitoring the activity states of a plurality of current altering devices in a circuit capable of conducting current from a source to a load comprising:

monitoring means having a plurality of device status inputs for electrically coupling to said devices for providing a plurality of fault status signals indicating the activity state of said devices;

said monitoring means further having a cascade input for daisy-chain connection to another like monitoring apparatus;

means for providing a clock signal when said current flow is altered by one or more of said devices;

latch means responsively coupled to said device status inputs for storing said fault status signals in response to said clock signal, said latch means having a plurality of output terminals for providing logic signals indicative of said stored fault status signals;

fault identifying means responsively coupled to said cascade input and to said latch output terminals and responsive to said devices which altered said current flow and for providing an indication thereof;

said fault identifying means further having a cascade output for daisy-chain connection to yet another like monitoring apparatus.

2. The apparatus of claim 1 wherein said monitoring means continuously provides said plurality of fault status signals.

3. The apparatus of claim 1 wherein said monitoring means comprises isolation means having an input port for electrically coupling to at least one of said devices and having an output port for providing at least one of said plurality of fault status signals, said isolation means providing high impedance between said input port and said output port.

4. The apparatus of claim 1 wherein said monitoring means includes opto-isolator means for coupling to said devices.

5. The apparatus of claim 1 wherein said monitoring means includes means for gating direct current in accordance with the activity state of said devices.

6. The apparatus of claim 1 wherein said means for providing a clock signal includes means responsive to said monitoring means.

7. The apparatus of claim 1 wherein said means for providing a clock signal includes means for providing said clock signal only after said current flow is altered by one or more of said devices for a predetermined time interval.

8. The apparatus of claim 1 wherein said means for providing a clock signal includes first bistable means for changing from a first logical state to a second logical state in response to said fault status signals.

9. The apparatus of claim 8 wherein said means for providing a clock signal includes second bistable means responsive to said first bistable means for changing from a first logical state to a second logical state.

10. The apparatus of claim 1 wherein said latch means includes a plurality of bistable means receptive of said fault status signals for latching in a logical state indicative of the activity state of said devices in response to said clock signal.

11. The apparatus of claim 1 further comprising resetting means for initializing said latch means.

12. The apparatus of claim 1 further comprising resetting means for initializing said means for providing a clock signal.

13. The apparatus of claim 1 further comprising switching means responsive to said fault identifying means and capable of conducting and interrupting alternating current.

14. The apparatus of claim 1 wherein said means for providing a clock signal includes means for providing a clock signal to a second apparatus for monitoring the activity states of a second plurality of series connected current altering devices.

15. The apparatus of claim 1 wherein said fault identifying means includes a plurality of input nodes each receptive of a different one of said logic signals and means for comparing said logic signals at said nodes with one another.

16. The apparatus of claim 1 wherein said fault identifying means includes a plurality of input nodes each receptive of a different one of said logic signals, and means for series connecting said nodes and for providing an indication signal when adjacent nodes are at different electric potentials.

17. The apparatus of claim 16 wherein said means for series connecting said nodes includes diode junction.

18. The apparatus of claim 16 wherein said means for series connecting said nodes includes a light emitting diode for producing said indication signal.

19. An apparatus for monitoring the activity states of a plurality of switches in an emergency stop circuit coupled between a current source and a load, comprising:

monitoring means having a plurality of switch status inputs for coupling to the switches in said emergency stop circuit and having a plurality of output ports which are conductively isolated from said switch status inputs for providing a plurality of fault status signals indicating the activity states of said switches;

said monitoring means further having a cascade input for daisy-chain connection to another like monitoring apparatus;

means for providing a clock signal when the activity state of one of said switches is altered;

latch means coupled to said output ports of said monitoring means for storing said fault status signals in response to said clock signal, said latch means having a plurality of output terminals for providing logic signals indicative of said stored fault status signals;

a ladder network having a plurality of series connected resistor diode pairs, the pairs being series connected to define a ladder, a first one of said pairs being responsively coupled to said cascade input and the remainder of said pairs being responsively coupled to said output terminals of said latch means;

means coupled to said ladder network means for detecting the existence of current flow through each of said resistor diode pairs and for providing a signal indicative of said current flow, said signal indicative of the existence of current flow also being indicative of the activity states of said switches.

* * * * *

UNITED STATES PATENT AND TRADEMARK OFFICE

CERTIFICATE OF CORRECTION

PATENT NO. : 4,616,216

DATED : October 7, 1986

INVENTOR(S) : Jack Meirow et al.

It is certified that error appears in the above-identified patent and that said Letters Patent is hereby corrected as shown below:

On the title page assignee should read

--(73) Assignee: Jack Meirow --.

Signed and Sealed this

Twenty-fourth Day of November, 1987

*Attest:*

DONALD J. QUIGG

*Attesting Officer*

*Commissioner of Patents and Trademarks*